US006718578B2

(12) United States Patent
Li

(10) Patent No.: US 6,718,578 B2
(45) Date of Patent: Apr. 13, 2004

(54) BLANKET HAVING EXTENDABLE SUPPORTS

(76) Inventor: Hongbiao Li, 1704 Fernwood, Plano, TX (US) 75075

( * ) Notice: Subject to any disclaimer, the term of this patent is extended or adjusted under 35 U.S.C. 154(b) by 0 days.

(21) Appl. No.: 10/244,945

(22) Filed: Sep. 17, 2002

(65) Prior Publication Data

US 2004/0049850 A1 Mar. 18, 2004

Related U.S. Application Data

(63) Continuation-in-part of application No. 10/234,795, filed on Sep. 4, 2002.

(51) Int. Cl.[7] ..... A47G 9/02
(52) U.S. Cl. ..... 5/482; 5/486; 5/494; 5/585.1
(58) Field of Search ..... 5/782, 494, 498, 5/504.1, 505.1, 506.1, 414, 486; 128/872

(56) References Cited

U.S. PATENT DOCUMENTS 1,130,781 A * 3/1915 Wiley ..... 5/498
2,343,587 A * 3/1944 Siegelbaum ..... 5/93.1
2,602,171 A * 7/1952 Good ..... 5/505.1
4,975,997 A * 12/1990 Misiura et al. ..... 5/505.1
5,713,090 A * 2/1998 Rodgers ..... 5/505.1
6,457,193 B1 * 10/2002 Li ..... 5/482

* cited by examiner

*Primary Examiner*—Michael F. Trettel
(74) *Attorney, Agent, or Firm*—Michael L. Diaz

(57) ABSTRACT

A blanket providing enhanced ventilation and preventing a person from inadvertently removing the blanket from the person's body. The blanket includes a sheet of material having a reinforcing section embedded within a perimeter of the sheet of material. The reinforcing section may be a tube containing trapped air. In addition, the blanket may include supports connected to a collar section. The supports allow the blanket to be raised a specified distance above the person lying under the blanket. When the person releases the blanket, the blanket returns to its original position, lying over the person. The blanket may also includes several apertures allowing air to pass through the blanket.

11 Claims, 4 Drawing Sheets

BLANKET HAVING EXTENDABLE SUPPORTS

RELATED APPLICATIONS

This application is a continuation-in-part of a co-pending U.S. patent application Ser. No. 10/234,795 entitled "Ventilated Blanket," filed Sep. 4, 2002 in the name of Hongbiao Li, which is hereby incorporated in its entirety by reference herein.

BACKGROUND OF THE INVENTION

1. Technical Field of the Invention

This invention relates to blankets and, more particularly, to a blanket which prevents a person from removing the blanket from the person's body.

2. Description of Related Art

The use of a blanket by an individual provides warmth and comfort to a sleeping person. Co-pending U.S. patent application Ser. No. 09/923,700 ('700) describes a blanket for use on a baby to prevent the baby from removing the blanket from the baby's body. Although '700 discloses an effective way of preventing a baby from removing a blanket, '700 does not disclose a blanket which provides increased ventilation to a baby.

When a person covers a main portion of his body with a blanket, air is trapped underneath the blanket. This trapped air becomes stale and oftentimes, uncomfortably warm. In addition, it is well known that a person's skin must be constantly exposed to fresh air for maintaining healthy skin. Thus, positioning a blanket over a person, or a baby, is both uncomfortable and unhealthy. The baby instinctively attempts to remove the blanket. On the other hand, an adult has learned to endure the uncomfortable feeling of exposing a majority of the person's body to stale and unhealthy air. A blanket is needed which provides enhanced ventilation, while still allowing the person to properly cover his body.

In addition, the baby blanket disclosed in '700 discloses a mechanism for allowing the baby to lift the blanket, yet prevents the baby from removing the blanket from his body. To enhance the effectiveness of the disclosed blanket, air passageways may be utilized to functionally prevent the baby from removing the blanket. Thus, it would be a distinct advantage to have a blanket which prevents a person from removing the blanket from his body while sleeping. Additionally, it would be advantageous to have a blanket which provides enhanced ventilation to a person utilizing the blanket. It is an object of the present invention to provide such an apparatus.

SUMMARY OF THE INVENTION

In one aspect, the present invention is a blanket for use over a person. The blanket includes a sheet of material and a reinforcing section affixed to the sheet of material. The reinforcing section provides a substantial rigidity to a portion of the blanket. The blanket also includes a vertically raised section located on the sheet of material for raising a portion of the sheet of material away from a horizontal surface on which the sheet of material lies. The vertically raised section is extendable from the sheet of material. The person is positioned under the blanket. The reinforcing section and the vertically raised section prevent the person from moving the blanket off a body of the person while allowing restricted movement of the blanket.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
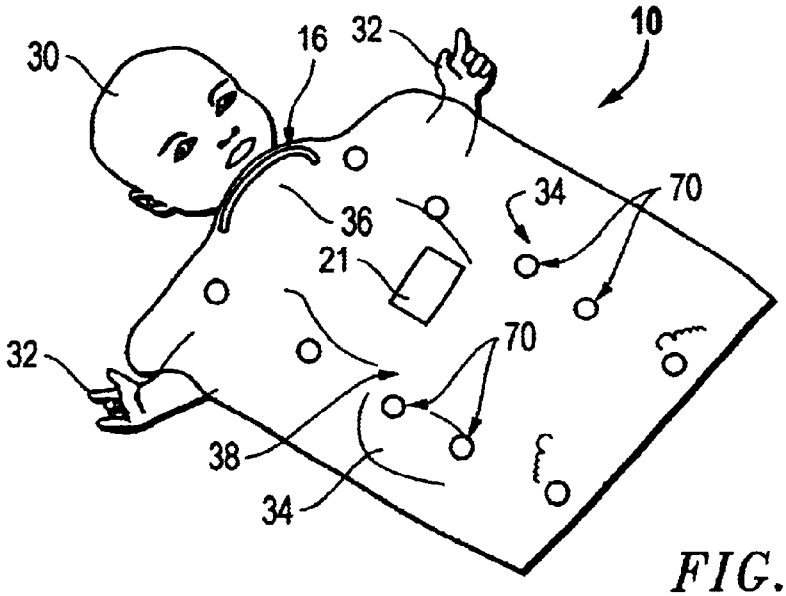
FIG. 1 is a top perspective view of a person lying underneath a blanket in the preferred embodiment of the present invention.

The present invention is a blanket providing enhanced ventilation to a person lying underneath the blanket, as well as preventing the person from inadvertently moving the blanket away from the person's body. FIG. 1 is a top perspective view of a person 30 lying underneath a blanket 10 in the preferred embodiment of the present invention. The blanket includes a flexible reinforcing section 12 (not shown in FIG. 1). The blanket may be constructed of any material. Typically the material is soft and flexible for the comfort of the baby. Preferably, the reinforcing section 12 is embedded within the interior portion of the blanket, thus removing the reinforcing section from view. However, in alternate embodiments of the present invention, the reinforcing section is affixed to an outer surface of the blanket. Preferably, the reinforcing section is located on a perimeter of the blanket. The reinforcing section may also taper inwardly toward a top portion of the blanket. Preferably, the reinforcing section is one or more tubes constructed of a flexible material such as a thin plastic. Within the interior of the tubes is trapped air.

In the preferred embodiment of the present invention, a vertically raised collar section 16 is located at the top portion of the blanket, in the general vicinity of the head and neck of the person. The reinforcing section is preferably constructed of a semi-flexible material providing some rigidity to the blanket to which it is attached. By providing a substantially rigid perimeter on the blanket, the person cannot remove the blanket away from the person's body without the blanket returning to its original configuration. However, the interior portion of the blanket still allows the baby to move.

The blanket 10 may also include a thermometer 21 indicating the ambient air temperature underneath the blanket. In order to insure that the person (baby) is kept at the proper temperature, the thermometer may be used to indicate to adults via a visual indication showing the temperature or an aural indicator, indicating when the temperature is above or below a desired temperature range. The use of a thermometer and associated visual and aural indicators are well known in the art of temperature measurement devices.

In the preferred embodiment of the present invention, the blanket optionally includes a plurality of apertures 70 spread in various locations on the blanket. Preferably, the apertures are sufficiently spaced from each other to provide sufficient ventilation to a person located under the blanket.

Figure 2:
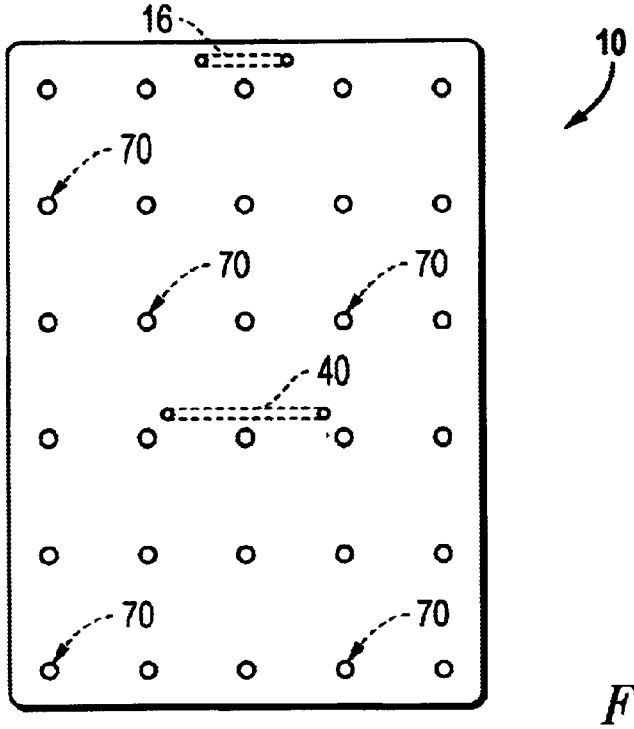
FIG. 2 is a top view of the blanket in a first alternate embodiment of the present invention.

FIG. 2 is a top view of the blanket in a first alternate embodiment of the present invention. It should be understood that the apertures may be any number and located anywhere on the blanket 10. As depicted in FIG. 2, more apertures 70 are located on the blanket. Additionally, the blanket may include one or more vertically raised sections. FIG. 2 depicts a vertically raised waist section 40. In alternate embodiments, the vertically raised sections may be located on other parts of the person's body, such as his arms or legs. It must be understood, that vertically raised sections may be located anywhere on the blanket and with any selected number of sections as desired to prevent the person from removing the blanket.

Figure 3:
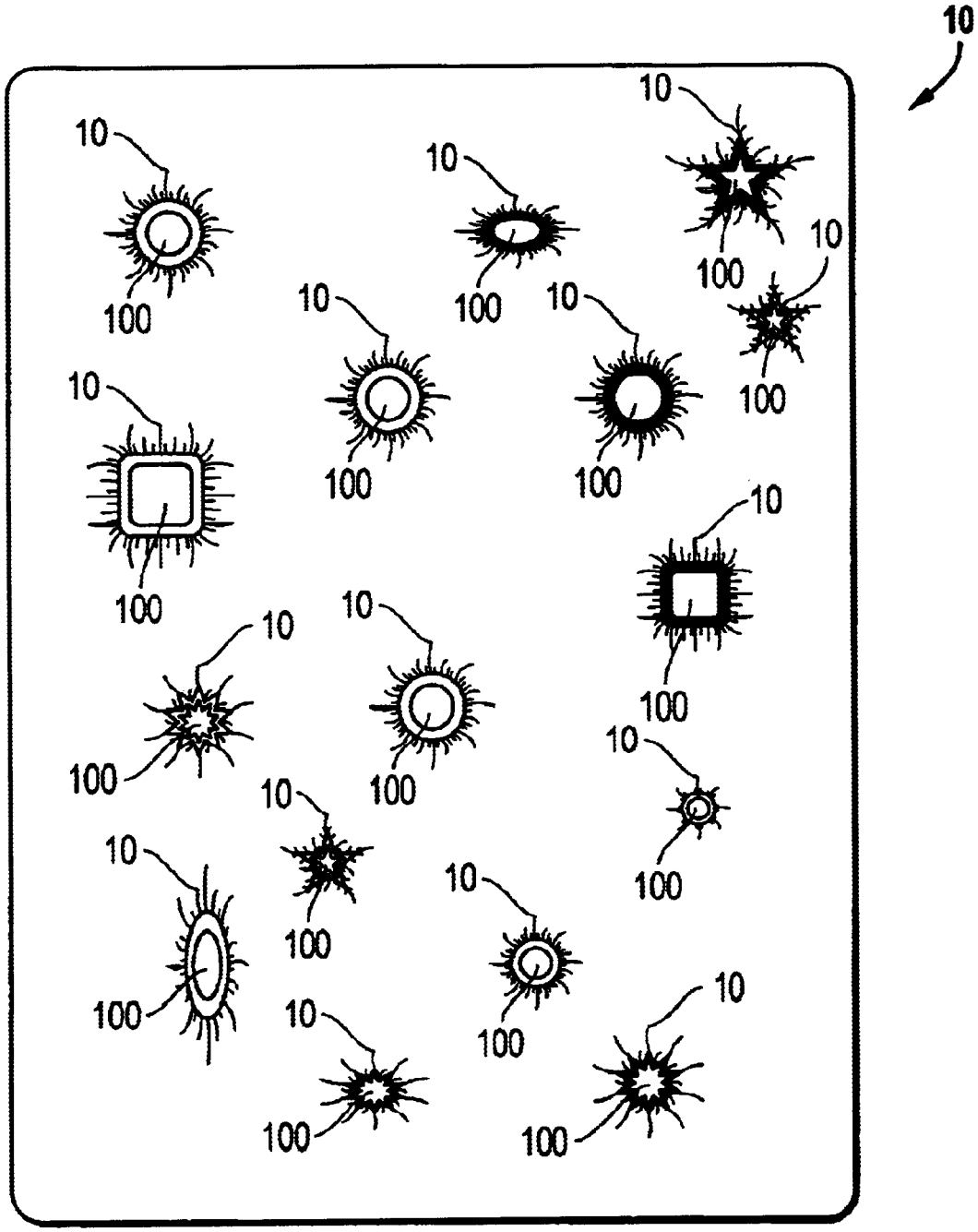
FIG. 3 is a top view of a plurality of apertures located on the blanket 10 in the preferred embodiment of the present invention.

FIG. 3 is a top view of a plurality of apertures 70 located on the blanket 10 in the preferred embodiment of the present invention. The apertures may be affixed in any manner to the blanket which allows air to flow through the blanket. The aperture may also include a perimeter 100 to gather the material inwardly to facilitate a passageway through the blanket. Several shapes and sizes of apertures are depicted, although it should be understood that any size, number and shape of apertures may be utilized on the blanket 10. In addition, the aperture may be concealed by a covering, yet still allow the flow of air through the blanket. For example, a mesh covering may be utilized. In an alternate embodiment, the covering may including several perimeter openings allowing the passage of air around the covering into the aperture.

Figure 4:
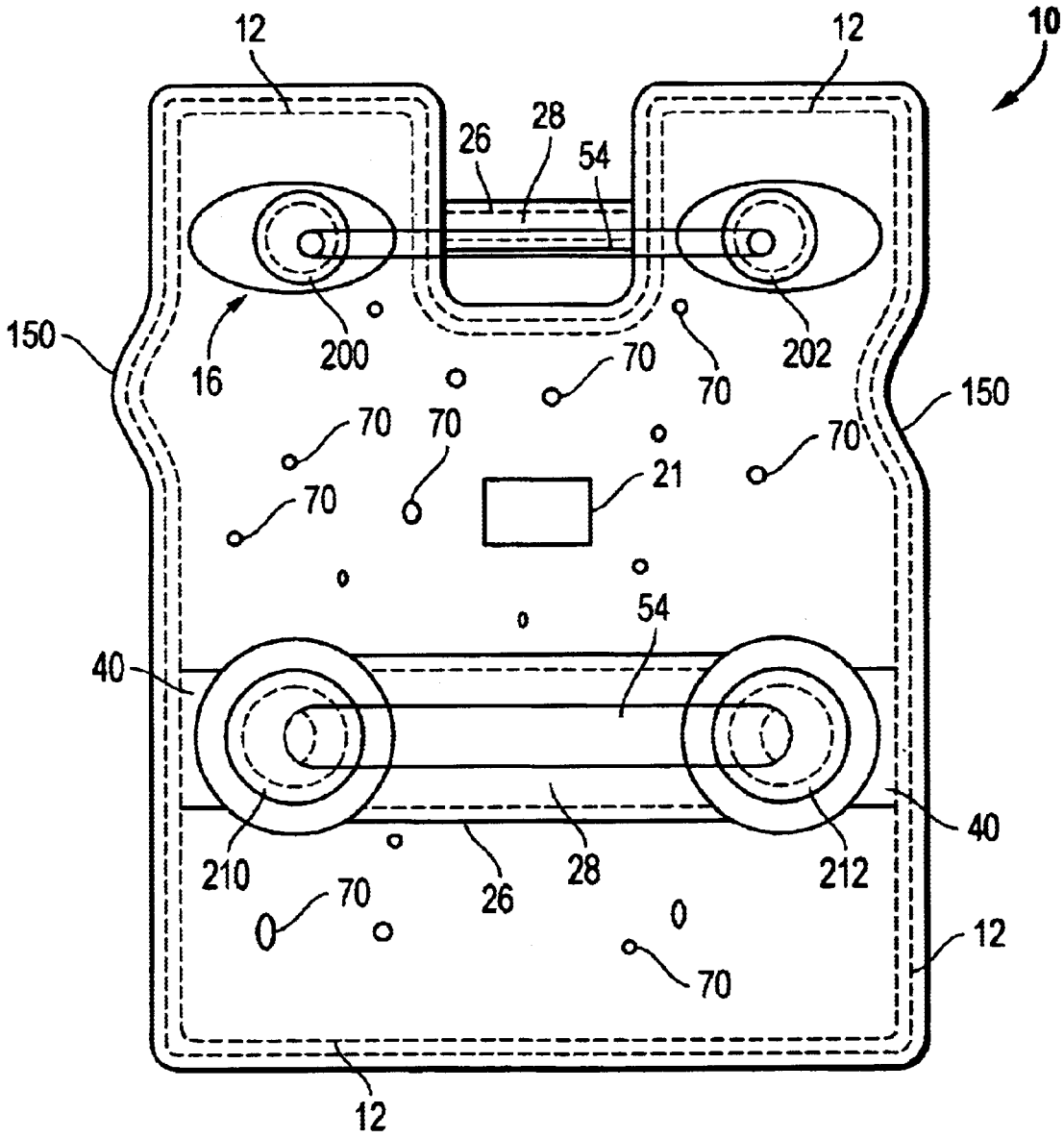
FIG. 4 is a top view of the blanket illustrating a plurality of extendable supports in the preferred embodiment of the present invention.

FIG. 4 is a top view of the blanket 10 illustrating a plurality of extendable supports in the preferred embodiment of the present invention. The blanket may include the raised collar section having a curved portion 26. In addition, the reinforcing section 12 is preferably located on a perimeter of the blanket. However, in alternate embodiments of the present invention, the reinforcing section may be located anywhere on the blanket 10. The blanket, as discussed above, includes a plurality of apertures 70. As shown in FIG. 4, the reinforcing section 12 is configured with a curved shaped at the position where the person's head and neck area are typically located. In addition, the reinforcing section may be curved at the location 150 where the arms of the person may extend from the blanket. The curved portion 26 is positioned above the neck area of the person.

The raised collar section may include a plurality of extendable supports 200 and 202. The supports retain the curved portion on an outer surface of the blanket. Additionally, the blanket may optionally include a vertically raised waist section 40 which is located over the waist of the person lying under the blanket. The vertically raised waist section includes two supports 210 and 212.

Figure 5:
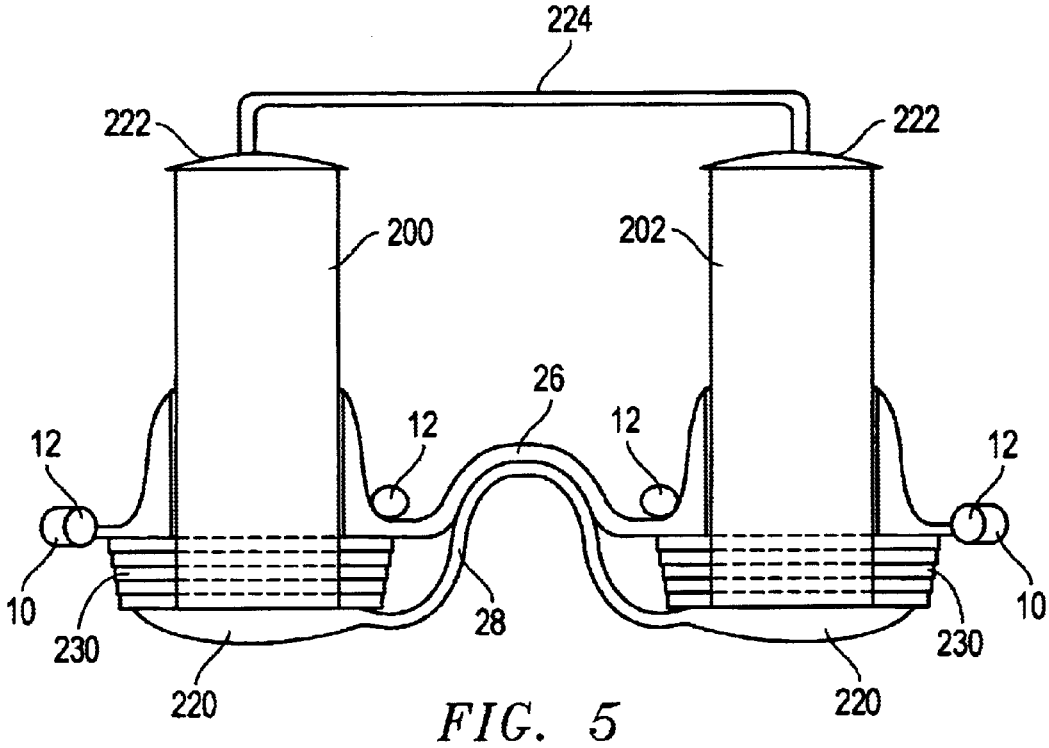
FIG. 5 is an enlarged cross sectional view of the supports and the collar section in the retracted position of FIG. 4.

FIG. 5 is an enlarged cross sectional view of the supports 200 and 202 and the collar section 16 in the retracted position of FIG. 4. The supports extend approximately perpendicular upwardly from the blanket. Each support includes a base 220 and a cap 222. The base preferably is weighted. Each cap is located at a top portion of the support and optionally connected to its corresponding adjacent support by a connector 224. Surrounding the support is an extendable sheath 230. The sheath preferably extends and retracts in the same manner as an accordion. As depicted in FIG. 5, the extendable sheath is in the retracted position. Each sheath is connected to the other sheath by the curved portion 26. In addition, each base is connected to its adjacent base by a connector 28.

Figure 6:
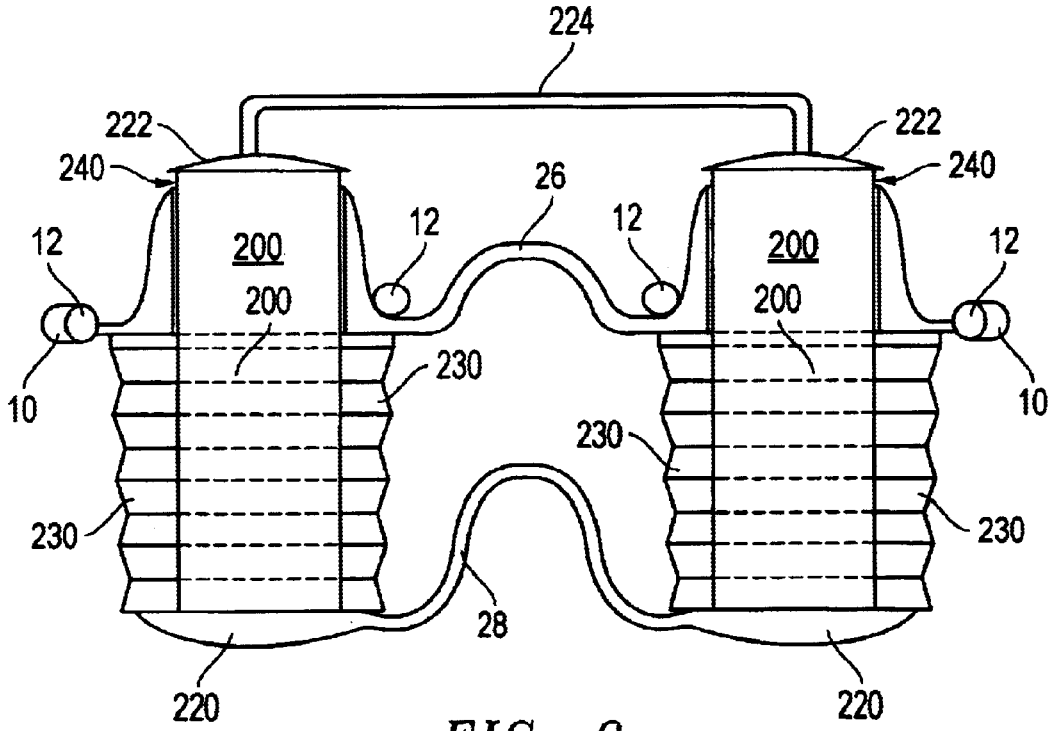
FIG. 6 is an enlarged cross sectional view of the supports and the collar section of FIG. 4 in the fully extended position.

FIG. 6 is an enlarged cross sectional view of the supports 200 and 202 and the collar section 16 of FIG. 5 in the fully extended position. The sheath may be extended out by a person pressing upwardly against the blanket. The blanket may be raised upwardly to the fully extended position. The sheath allows the blanket to rise and be guided by each support. Since the bases of each support are weighted, the bottom portion of each support remains relatively stationary, thus providing a base support as the blanket is moved upwardly. Once the person releases pressure to the blanket, the blanket returns to its original position. The sheath includes an opening 240 to accommodate placement of the support through the center of the sheath. As the sheath and associated blanket and curved portion 26 are raised, the sheath extends outwardly in an accordion-like manner. Without force being exerted upon the blanket, the sheath returns to its original retracted position by the weight of the blanket.

Referencing FIGS. 1–6, the blanket is positioned over a person. The curved portion preferably lies on top of the neck region of the person. During sleep, the person may attempt to raise the blanket. The blanket is allowed to raise along each support. When pressure is released by the person, the blanket returns to its original position. Since each base is weighted down, the base remains stationary. In addition, the reinforcing section 12 allows limited movement of the blanket. When pressure is released by the person, the blanket returns to its original position. In addition, the blanket may optionally include the plurality of apertures to allow the passage of air through the blanket.

With apertures optionally configured along the blanket 10, air is allowed to pass above and below the blanket, thus providing enhanced ventilation to the person lying under the blanket. The air flow may be directed around various passageways in any fashion to allow sufficient air to pass under the blanket, yet still comfortably cover the person.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A blanket for use over a person, the blanket comprising:

a sheet of material;

a reinforcing section affixed to the sheet of material, said reinforcing section providing a substantial rigidity to a portion of the blanket; and a vertically raised section located on the sheet of material for raising a portion of said sheet of material away from a horizontal surface on which said sheet of material lies, said vertically raised section being extendable from the sheet of material;

whereby the person is positioned under the blanket, said reinforcing section and said vertically raised section preventing the person from moving the blanket off a body of the person while allowing restricted movement of the blanket.

2. The blanket of claim 1 wherein said reinforcing section is a flexible tube having air trapped within the tube.

3. The blanket of claim 1 further comprising a plurality of apertures spaced on said sheet of material for allowing passage of air through said sheet of material.

4. The blanket of claim 3 wherein each aperture includes a perimeter providing a passageway through said sheet of material.

5. The blanket of claim 4 wherein each perimeter is affixed to said sheet of material.

6. The blanket of claim 1 wherein said vertically raised section includes at least two supports having weighted bases.

7. The blanket of claim 6 wherein each support includes an extendable sheath surrounding a length of the support.

8. The blanket of claim 7 wherein the extendable sheath extends and retracts in an accordion-like fashion.

9. The blanket of claim 1 further comprising a second vertically raised section for raising a second portion of said sheet of material away from the horizontal surface on which said sheet of material lies, said second vertically raised section being extendable from the sheet of material.

10. The blanket of claim 6 wherein said vertically raised section is located above a neck of the person.

11. The blanket of claim 6 wherein said vertically raised section is located above a waist of the person.

* * * * *